US007048041B2

(12) United States Patent
Brewer et al.

(10) Patent No.: US 7,048,041 B2
(45) Date of Patent: May 23, 2006

(54) SYSTEMS AND APPARATUSES FOR STABILIZING REACTOR FURNACE TUBES

(75) Inventors: John R. Brewer, Katy, TX (US); David J. Brown, Houston, TX (US); J. Parks Craig, Houston, TX (US); Chinh T. Dang, Houston, TX (US); Martyn D. Roberts, Houston, TX (US)

(73) Assignee: Stone & Webster Process Technology, Inc., Houston, TX (US)

( * ) Notice: Subject to any disclaimer, the term of this patent is extended or adjusted under 35 U.S.C. 154(b) by 264 days.

(21) Appl. No.: 10/627,037

(22) Filed: Jul. 25, 2003

(65) Prior Publication Data

US 2005/0019233 A1 Jan. 27, 2005

(51) Int. Cl.
*F28F 9/13* (2006.01)

(52) U.S. Cl. ..... 165/162; 165/172; 165/69

(58) Field of Classification Search ..... 165/162, 165/172, 69

See application file for complete search history.

(56) References Cited

U.S. PATENT DOCUMENTS

| | | | | | |
|---|---|---|---|---|---|
| 1,861,709 | A | * | 6/1932 | Moore | 165/172 |
| 2,018,619 | A | | 10/1935 | Winkler et al. | |
| 2,118,206 | A | * | 5/1938 | Kritzer et al. | 165/172 |
| 2,496,301 | A | * | 2/1950 | Meixl | 165/162 |
| 3,407,789 | A | | 10/1968 | Hallee et al. | |
| 3,671,198 | A | | 6/1972 | Wallace | |
| 3,929,189 | A | * | 12/1975 | Lecon | 165/69 |
| 4,013,024 | A | * | 3/1977 | Kochey et al. | 165/162 |
| 4,319,725 | A | * | 3/1982 | Meuschke et al. | 248/68.1 |
| 4,342,642 | A | | 8/1982 | Bauer et al. | |
| 4,499,055 | A | | 2/1985 | DiNicolantonio et al. | |
| 4,589,618 | A | * | 5/1986 | Fournier | 165/162 |
| 4,685,511 | A | * | 8/1987 | Sabatino | 165/162 |
| 4,834,173 | A | * | 5/1989 | Weiss et al. | 165/162 |
| 4,889,182 | A | * | 12/1989 | Kosters | 165/162 |
| 5,050,669 | A | * | 9/1991 | Nenstiel et al. | 165/162 |
| 5,427,655 | A | | 6/1995 | Woebcke et al. | |
| 5,589,428 | A | | 12/1996 | Divakar et al. | |
| 5,616,426 | A | | 4/1997 | Tenhover et al. | |
| 5,635,430 | A | | 6/1997 | Divakar et al. | |
| 5,813,845 | A | | 9/1998 | Eiermann | |
| 6,006,824 | A | * | 12/1999 | Hattori et al. | 165/162 |

FOREIGN PATENT DOCUMENTS

EP 1018563 A1 7/2000

OTHER PUBLICATIONS

C.S. Tassen et al., "High Temperature Service Experience and Corrosion Resistance for Mechanically Alloyed ODS Alloys," Sep., 23-26, 1991, p. 105,113,114.

Metzer et al., Understanding Silicon-Carbide Types-Having the Right Tool for the Job, World Coal Magazine, Feb. 2000.

Special Metals Corporation, Oxide Dispersion Strengthened Alloys Made by Mechanical Alloying, Publication No. SMC-004, 1999.

C.S. Tassen et al., "High Temperature Service Experience and Corrosion Resistance for Mechanically Alloyed ODS Alloys," Sep. 23-26, 1991.

* cited by examiner

*Primary Examiner*—Teresa J. Walberg
(74) *Attorney, Agent, or Firm*—Hedman & Costigan, P.C.; Alan B. Clement; John F. Volpe

(57) ABSTRACT

Systems and apparatuses for stabilizing the movement of the reactor furnace tubes of a fired heater, furnace, heat exchanger or other device utilizing reactor furnace tubes to thereby reduce harmful stresses on the tubes, extend the useful life of the tubes, increase the efficiency and safety of reaction processes and allow for the streamlining the design of the tubes.

20 Claims, 6 Drawing Sheets

SYSTEMS AND APPARATUSES FOR STABILIZING REACTOR FURNACE TUBES

FIELD OF THE PRESENT INVENTION

The present invention relates to systems and apparatuses for stabilizing the high-temperature process tubes of a fired heater, furnace, heat exchanger or other device utilizing high-temperature process tubes. More specifically, the present invention relates to systems and apparatuses for stabilizing reactor tubes within their housing device by limiting their movement. Most specifically, the present invention relates to systems and apparatuses for stabilizing reactor furnace tubes by using a framework of structural components to limit their movement and thereby reduce harmful stresses on the tubes, extend the useful life of the tubes, increase the efficiency and safety of reaction processes and allow for the streamlining the design of the tubes.

BACKGROUND OF THE PRESENT INVENTION

The present invention relates to systems and apparatuses for stabilizing the high-temperature process tubes of a fired heater, furnace, heat exchanger or other device that utilizes high-temperature process tubes. However, systems and apparatuses used in accordance with the present invention are particularly well suited and advantageous to the reactor tubes of furnaces used for the cracking of a variety of hydrocarbon feedstocks by pyrolysis to ethylene and other valuable olefinic gases. Accordingly, by way of illustration, but not limitation, the present invention will be described and explained in the context of that process.

Cracking furnaces long have been used in the process of cracking a variety of hydrocarbon feedstocks to ethylene and other valuable olefinic gases. There are at least several thousand such furnaces located in world refineries and petrochemical plants. U.S. Pat. Nos. 2,671,198, 3,407,789, 3,671,198, 4,342,642, 4,499,055 and 5,427,655 describe basic designs of short-residence time/high temperature cracking furnaces. In general, cracking furnaces vary in size and style but all contain reactor tubes, which transport the feedstock being heated and processed. The sensible heat and the heat of cracking are supplied by radiant heat from burners located on the floor and/or walls of the firebox of the furnace. This heat transfers through the reactor tubes into feedstock that flows therewithin.

Given the relatively high temperatures to which the reactor furnace tubes are exposed, metallic materials have been preferred for construction of reactor lines. Recent conventional reactor lines have been constructed of nickel-containing alloys, however, varying the materials used for reactor lines are found in the prior art. See, e.g., Winkler et al., U.S. Pat. No. 2,018,619, describing an apparatus that uses reactor tubes made from silicon powder; and European Patent Application EP 1 018 563 A1 describing constructing a portion of a heating furnace tube with a material comprising a rare earth oxide particle dispersion ("ODS") iron alloy.

The length of reactor furnace tubes varies and generally may range from about 10 feet to about 400 feet in length. Further, reactor furnace tubes may take many shapes. Although the present invention is particularly well suited and advantageous to reactor furnace tubes that are coiled in a serpentine shape or comprised of a series of u-shaped tubes, other configurations are within the contemplated scope of the present invention. Among the problems relevant to the present invention associated with reactor furnace tubes is the movement of the tubes due to harmonics, fluid momentum, thermal expansion and/or other forces. Such movement is sometimes referred to "swing." Movement of the tubes introduces harmful stresses in the tubes and their welds, which distort the shape of the tubes, reduce the useful life of the tubes and create a safety risk of tube or weld breakage. Such movement also disturbs the alignment of the tubes with the burners of the furnace, which is sometimes referred to as "shadowing," i.e., one tube blocking the radiant heat from reaching another tube. Misalignment also can reduce the efficiency of the process by allowing the reactor tubes to get too close or too far from the burners thereby causing inconsistent heat transfer. In addition, misalignment of the reactor furnace tubes can cause an increase in coke formation, a deleterious by-product of the process, within the tubes. The deposition of coke on the insides of the reactor furnace tubes constricts the flow path for the feedstock, causing an increased system pressure drop, and a decrease in the furnace capacity. Additionally, the coke deposition on the inside of reactor furnace tubes decreases the heat transfer of the radiant heat from the radiant burners through the tube wall to the hydrocarbons flowing through the tubes, which results in a decrease in the cracking yield. Coking in conventional reactor furnace tubes is major cause of furnace shutdown.

To date, manufacturers have welded locator pins to the return bends of u-shaped reactor furnace tubes in an attempt to limit their movement. Despite such efforts, the problems of "swing," "shadowing," misalignment and their adverse effects continue and there is no prior art that teaches or suggests systems or apparatuses for stabilizing reactor furnace tubes using a framework of structural components that effectively limits the movement of the reactor furnace tubes.

SUMMARY OF THE PRESENT INVENTION

The present invention concerns systems and apparatuses for stabilizing the high-temperature-process tubes of a fired heater, furnace, heat exchanger or other device utilizing high-temperature process tubes. Thus, it is an object of the present invention to provide systems and apparatuses to reduce the movement of high-temperature-process tubes due to harmonics, fluid momentum, thermal expansion or other forces.

It is still another object of the present invention to provide systems and apparatuses to reduce harmful stresses in reactor furnace tubes and their welds. Such stresses distort the shape of the tubes, reduce the useful life of the tubes and create a safety risk of tube or weld breakage.

It is still a further object of the present invention to provide systems and apparatuses that, in the case of a reactor furnace, maintain the alignment of reactor furnace tubes to the burners of the furnace thereby allowing consistent heat transfer and concomitantly increasing the efficiency of the reaction processes within the tubes and/or reducing coke formation within the tubes.

It is still another object of the present invention to provide systems and apparatuses that allow for streamlining the design of the reactor furnace tubes by eliminating the need for locator pins and the like.

It is still a further objective of the present invention to provide systems and apparatuses that may be used in the construction of a new fired heater, furnace, heat exchanger or other device utilizing high-temperature process tubes and/or retrofitted to an existing such device.

These and other objects are achieved by the present invention, which relates to systems and apparatuses for stabilizing high-temperature process tubes in devices utilizing such process tubes comprising surrounding a portion of said reactor tubes with at least one apparatus comprising at least two rods, having at least two spacers attached thereto, at least one rod retaining means on said rod wherein said rods and spacers are comprised of temperature-resistant material.

DETAILED DESCRIPTION OF THE PRESENT INVENTION

The following detailed description of present invention is provided to illustrate the present invention and is not to be construed to limit the scope of the appended claims in any manner whatsoever.

Figure 1A:
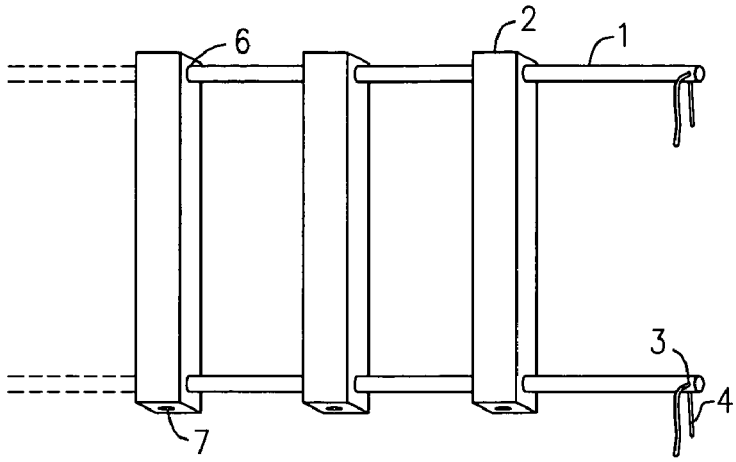
FIGS. 1A–1C depict several embodiments of stabilizing apparatuses useful in the practice of the present invention.

The apparatus depicted in FIG. 1A comprises an assembly of at least two rods 1 and a number of spacers 2 interconnecting the rods. The end of each rod 1 has a retainer attachment means 3, in this case openings, which cooperate with retaining means 4, in this case pins. The retainer attachment means 3 functions to hold the outermost spacers 2 on the rod 1 when the apparatus is assembled for use.

In the depicted embodiment, the rods 1 are cylindrical and solid and may have an outer diameter ranging from about 0.5" to about 2.0". In addition, the length of the rods may range from about 3' 0" to about 15' 0", depending upon, inter alia, the furnace size and the number of tubes to be stabilized. In the depicted embodiment, u-shaped pins 4 serve as the retaining means.

In other embodiments, the rods need not be cylindrical and/or solid and may be of any dimensions known to those skilled in the art. Further, the length of the rods may vary based, for example, on the number of the reactor tubes to be stabilized and the number of apparatuses the user desires to apply in stabilizing the tubes. The longer the rods, the fewer number of apparatuses will be needed. In addition, the dimension of the pins may vary based upon the size of the openings in the rods. Further, the pins need not be u-shaped but may take the form of cotter pins. In addition, any means known to those skilled in the art may be used to as the means of retaining the outermost spacers on the rods.

Figure 1B:
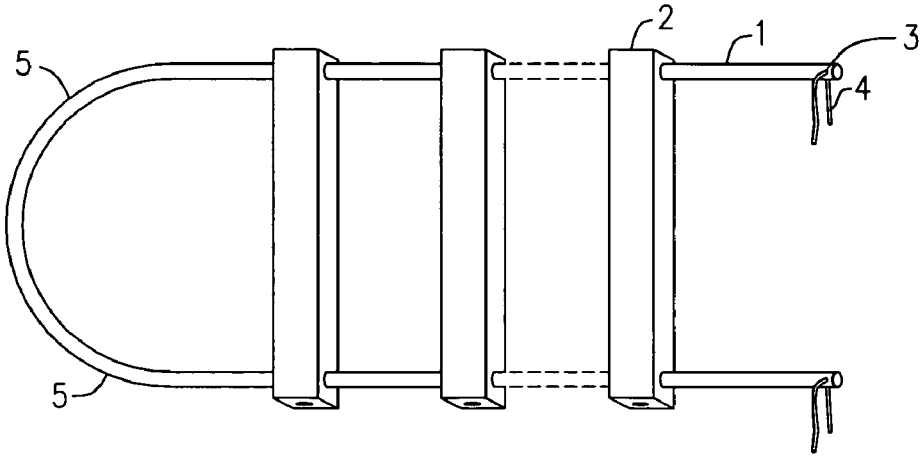
Figure 1C:
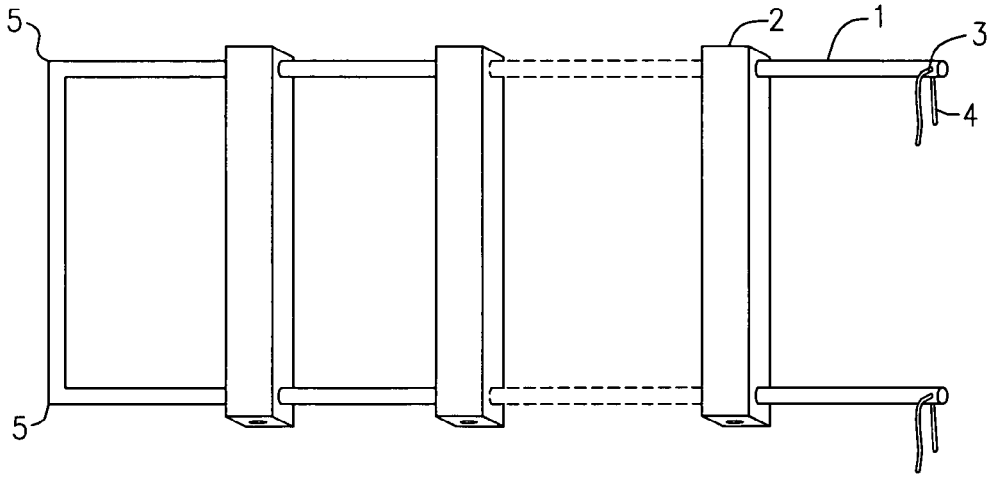

In still other preferred embodiments, bending a length of ODS rod material in half or in any other manner such that the rods are parallel and integrally attached at one end 5 may form the rods. Such embodiments are depicted in FIG. 1B and FIG. 1C. In still further such embodiments, the rods may be removably or permanently attached at one end by any means known to those skilled in the art.

Referring again to FIG. 1A, the spacers 2 of the apparatuses useful in the present invention are depicted. The spacers useful in the practice of the present invention can vary widely in length, width and depth depending on the specific application, but preferably range from about 4" to about 12" in length, about 1" to about 3" in width and about 1" to about 3" in depth. In addition, the ends of each spacer 2 have openings 6 of a sufficient size so as to permit sliding attachment to the rods 1. The depicted spacers 2 have hollows 7 that can be used to tighten spacers 2 in position on rods 1, such as by use of a screw. The number of spacers to be used will vary based on the number of reactor furnace tubes desired to be stabilized and/or the length of the rods. One preferred embodiment utilizes from about 6 to about 10 spacers. Further, in other embodiments, the spacers need not have hollows 7 and may be of any dimensions and/or configurations known to those skilled in the art.

The rods 1, spacers 2 and retaining means 4 of the present invention are comprised of a high strength, high-temperature resistant material. The materials used for the apparatuses should be able to withstand at least the same temperatures as the reactor tubes being stabilized. Preferred materials include the nickel alloys used to construct conventional reactor lines, ceramics or ODS materials, or any combination thereof. Especially preferred materials for the rods and spacers are ceramics or ODS, or a combination thereof. The use of ceramics or oxide dispersion strengthened materials is preferred for their ability to resist carburization at the high temperatures in the furnace. Where pins are used as the retaining means, an especially preferred material for their construction is ODS alloy wire.

The ceramic materials useful in the process of the present invention for constructing the spacers and the rods are any of the known ceramic materials that can be fashioned into the desired shape and include, but are not limited to, silicon-carbide materials such as a direct sintered silicon-carbide (typically abbreviated DSSiC, DSSC, alpha and beta bond phases). Examples of DSSiC materials include, but are not limited to, those sold under the trade name, Hexoloy SA by Saint-Gobain, Advanced Ceramics (formerly Carborundum) and under the trade name Halsic-S by W. Haldenwanger Technische Keramik GmbH & Co. KG. Further, the spacers and/or rods may be constructed of a wide variety of other SiC-based ceramic materials including, by way of example, materials taken from the group consisting of alpha silicon carbide, reaction bonded silicon carbide, silicon nitride, alumina, alumina/silicon carbide composites and composites based on silicon carbide. In addition, other useful ceramic materials may present themselves to those skilled in the art. See, for example, Jones, Divakar et al., U.S. Pat. No. 5,589,428, Tenhover et al., U.S. Pat. No. 5,616,426; Divakar et al., U.S. Pat. No. 5,635,430; Eiermann, U.S. Pat. No. 5,813,845. Other families of ceramic materials useful in the preparing the apparatuses of the present invention can be found at the web site having the URL address of http://www.scprobond.com/tech_corner.asp, wherein an excerpt of Metzger et al., "Understanding Silicon Carbide Types—Having the Right Tool for the Job" from the February 2000 issue of World Coal Magazine is reprinted.

Another useful material for constructing apparatuses in accordance with the present invention is what is commonly known as ODS materials. An exemplary ODS material useful in the practice of the present invention is a rare earth oxide dispersion strengthened ferrous alloy sold under the trade name Super Alloy Incoloy® MA956 by Specialty Metals Corporation; a virtually equivalent material is sold under the trade name PM 2000 by Plansee. However, the apparatuses may be constructed of a wide variety of other useful ODS materials including, by way of example, a rare earth oxide dispersion strengthened ferrous alloy which contains from about 17% to about 26% of Cr by weight and about 2% to about 6% of Al by weight.

Other useful ODS materials for constructing apparatuses in accordance with the present invention may suggest themselves to those skilled in the art in light of the present description. Non-limiting descriptions of ODS materials useful in the practice of the present invention can be found in an article by I. G. Wright, C. G. McKamey, B. A. Pint and P. J. Maziasz, of Oak Ridge National Laboratory, entitled "ODS Alloys for High-Temperature Applications;" in Yamamoto et al., European Patent Application No. EP 1 018 563 A1; and in the paper by Tassen et al., entitled "High Temperature service Experience and Corrosion Resistance for Mechanically Alloyed ODS Alloys," Heat-Resistant Materials, Proceedings of the First International Conference, Fontana, Wis., 23–26 Sep. 1991.

Figure 2:
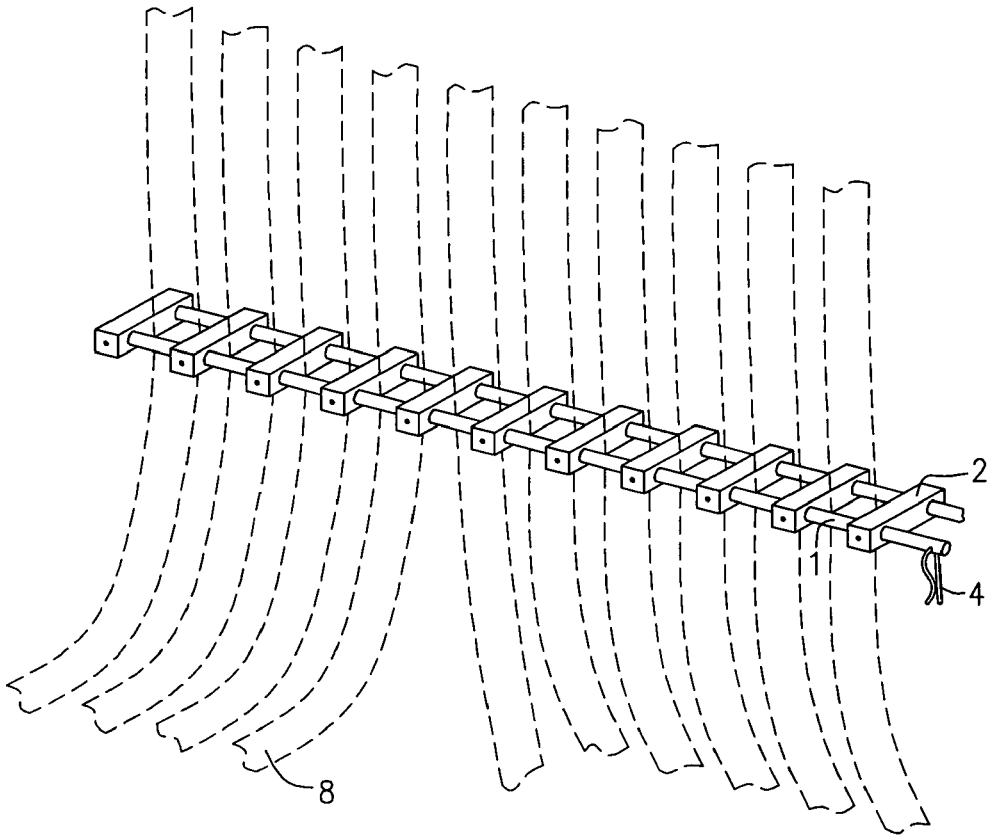
FIG. 2 depicts an embodiment of a stabilizing apparatus of the present invention as it is first attached to unshaped reactor furnace tubes in the practice of the present invention.

FIG. 2 depicts an embodiment of a stabilizing apparatus as it is first attached to reactor furnace tubes 8 of a pyrolysis reactor in the practice of the present invention. Therein is shown the rods 1, spacers 2, and retaining means 4 of an apparatus. The FIG. 2 depicts u-shaped reactor furnace tubes. However, the reactor furnace tubes may be of any configuration practiced in the art, such as serpentine, swaged, bent or offset, straight, horizontal or vertical, or any combination thereof.

Figure 3:
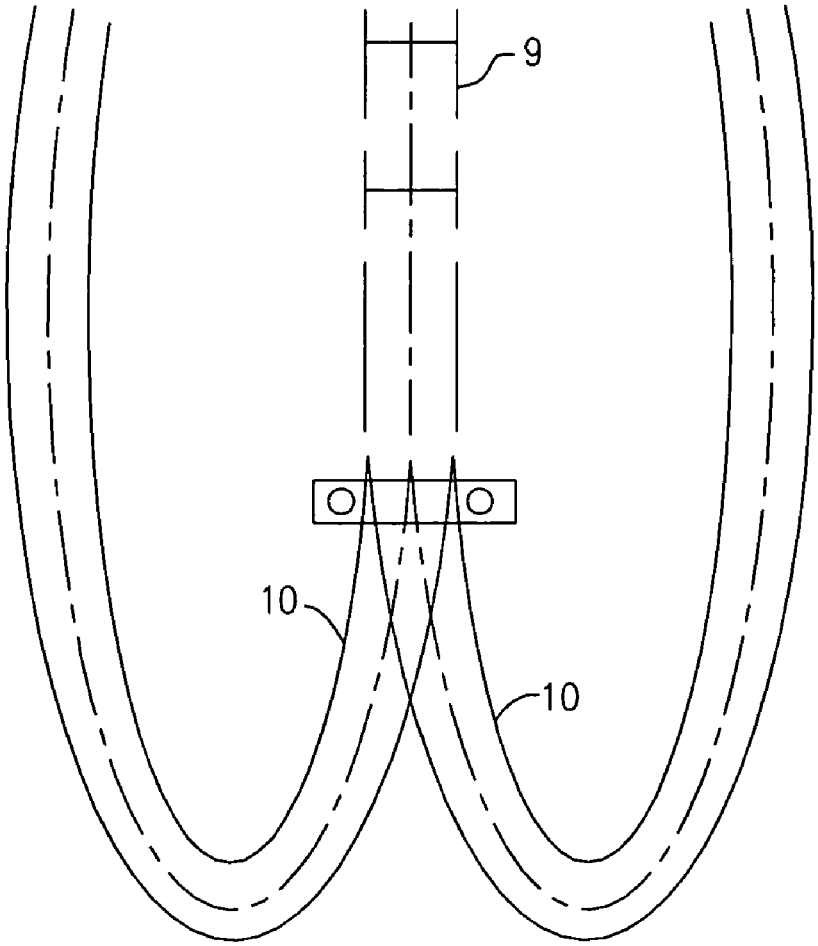
FIG. 3 depicts a side view of an embodiment of a stabilizing apparatus of the present invention after it has been fully installed on u-shaped reactor furnace tubes so as to stabilize the movement of the reactor tubes.

With regard to the systems of using the apparatuses to stabilize the movement of the reactor furnace tubes, reference is first had to FIG. 3. In order to install the apparatuses depicted in FIGS. 1A–1C, one leg of the reactor furnace tubes 9 are first held in alignment. This may be accomplished by means of clamping two straight pieces of timber or the like to either side of the tubes or by any other means known to those skilled in the art.

Figure 4:
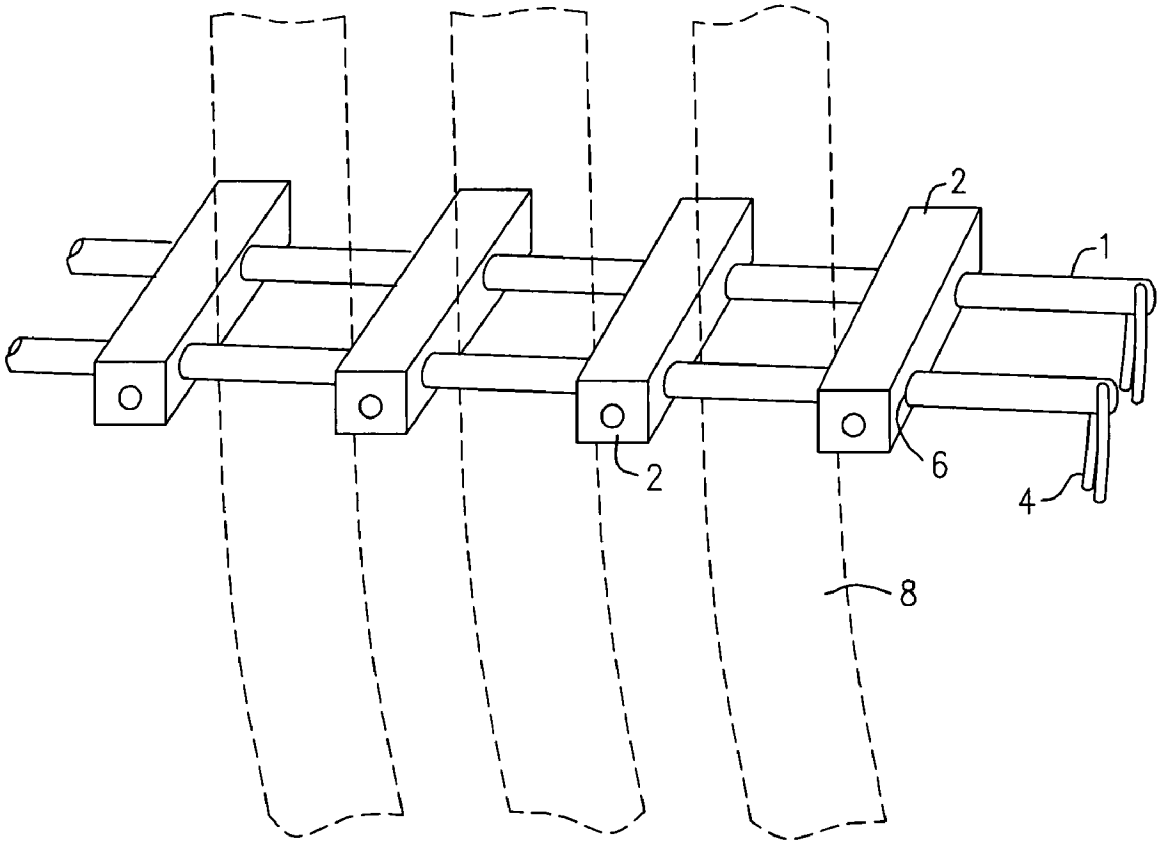
FIG. 4 depicts an exploded view of an embodiment of a stabilizing apparatus of the present invention as attached to a u-shaped reactor furnace tube in accordance with the present invention.
Figure 5:
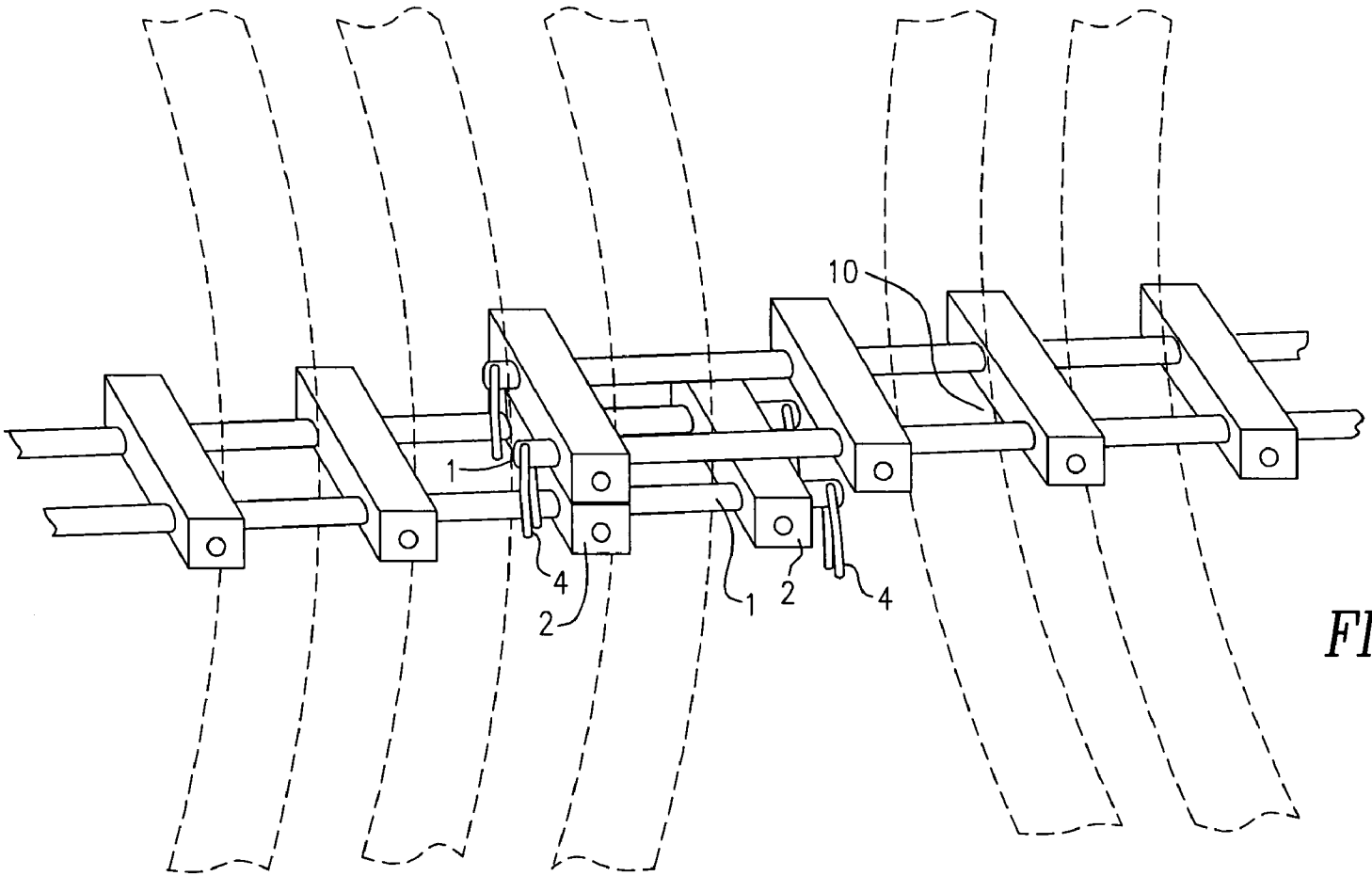
FIG. 5 depicts an embodiment of two stabilizing apparatuses of the present invention after they have been fully installed so as to stabilize the movement of u-shaped reactor furnace tubes.

With reference to FIG. 4, a spacer 2 may be placed in front of the first tube 8 to be surrounded and rods 1 are slid or threaded through the openings 6 on each end of the spacer. Where the apparatus is one in which either end of the rods has a retainer attachment means (see, e.g. FIG. 1A), a retaining means 4 is attached to the end of each rod that is closest to the spacer 2 so as to keep the end spacer from slipping off the rods. Where the apparatus is one in which the rods are parallel and integrally attached at one end (see, e.g, FIGS. 1B and 1C), this step is not necessary. Thereafter, an additional spacer 2' is slipped onto the rods so as to surround the first tube 8. This process is continued until several tubes are surrounded and the rod can no longer hold any more spacers, at which point, a pin or other retaining means is attached to retainer attachment means at the end of each rod that is closest to the last spacer added (not shown). The pins may be bent or the retaining means otherwise adjusted so as to remain engaged with the rods. Thereafter, the assembled apparatus is lowered into a position such that it rests on the curved area of each the "u" 10 of the u-shaped reactor furnace tubes (see FIGS. 3 and 5). The weight of the apparatuses locks or wedges them firmly against the curved areas 10 thereby stabilizing the tubes by limiting their movement. Additional apparatuses may be applied to the remaining tubes until all or many of the tubes have been so stabilized. Additional apparatus may also be placed directly on top of the first apparatus where desired for extra stability. Thereafter, the timber or other first means used to align the tubes are removed. FIG. 5 depicts two stabilizing apparatuses that have been fully installed so as to stabilize the movement of two sets of tubes in a pyrolysis furnace.

Although the systems and apparatuses of the present invention have been described in certain preferred embodiments, all variations obvious to one skilled in the art are intended to fall within the spirit and scope of the invention, including the appended claims. For example, the number, shape, size and configuration of the rods, spacers, retaining attachment means and/or retaining means could be varied in numerous ways that may present themselves to those skilled in the art. Such variations are within the full-intended scope of the present invention. All of the above-referenced patents, patent applications and publications are hereby incorporated by reference in their entirety.

The invention claimed is:

1. A system for stabilizing supported high-temperature process tubes in a radiant device utilizing high-temperature process tubes said system comprising surrounding a portion of said process tubes with at least one apparatus comprising at least two substantially straight rods having at least two spacers for separating and stabilizing said tubes, wherein said spacers have openings for attaching to said rods, at least one removable rod retaining means on at least one end of said rod to retain at least one spacer on one or more rods wherein said rods and spacers are comprised of temperature-resistant material.

2. A system as defined in claim 1 wherein said high temperature process tubes comprise reactor furnace tubes.

3. A system as defined in claim 2 wherein said device is a pyrolysis furnace.

4. A system as defined in claim 2 wherein said reactor furnace tubes are u-shaped.

5. A system as defined in claim 2 wherein said reactor furnace tubes are serpentine.

6. A system as defined in claim 2 wherein said reactor furnace tubes are bent or offset.

7. A system as defined in claim 2 wherein said reactor furnace tubes are swaged.

8. A system as defined in claim 2 wherein said reactor furnace tubes are straight vertical tubes.

9. A system as defined in claim 1 wherein said apparatus is constructed of temperature-resistant, non-nickel-containing material.

10. A system as defined in claim 1 wherein at least one said process tube is constructed of temperature-resistant, non-nickel-containing material.

11. A system as defined in claim 9 wherein said apparatus is constructed of ceramic material, an oxide dispersion strengthened ferrous alloy or any combination thereof.

12. A system as defined in claim 11 wherein said ceramic material is selected from the group consisting of alpha silicon carbide, reactor bonded silicon carbide, silicon nitride, alumina, alumina/silicon carbide composites and composites based on silicon carbide.

13. A system as defined in claim 11 wherein said ceramic material comprises a direct sintered silicon-carbide.

14. A system as defined in claim 11 wherein said oxide dispersion strengthened ferrous alloy comprises a rare earth oxide dispersion strengthened ferrous alloy which contains from about 17% to about 26% of Cr by weight and about 2% to about 6% of Al by weight.

15. An apparatus for stabilizing reactor furnace tubes in a device utilizing reactor furnace tubes said apparatus comprising at least two rods, having at least two spacers for separating said tubes wherein said spacers have an opening for attaching to said rods, and at least one removable rod attachment means on at least one end of said rods wherein said rods, spacers and retaining means are comprised of temperature-resistant materials.

16. An apparatus as defined in claim 15 wherein said apparatus is constructed of temperature-resistant, non-nickel-containing material.

17. An apparatus as defined in claim 15 wherein said apparatus is constructed of ceramic material, an oxide dispersion strengthened ferrous alloy or any combination thereof.

18. An apparatus as defined in claim 17 wherein said ceramic material is selected from the group consisting of alpha silicon carbide, reaction bonded silicon carbide, silicon nitride, alumina, alumina/silicon carbide composites and composites based on silicon carbide.

19. An apparatus as defined in claim 17 wherein said ceramic material comprises a direct sintered silicon-carbide.

20. An apparatus as defined in claim 17 wherein said oxide dispersion strengthened ferrous alloy comprises a rare earth oxide dispersion strengthened ferrous alloy which contains from about 17% to about 26% of Cr by weight and about 2% to about 6% of Al by weight.

* * * * *